US005803480A

United States Patent [19]

Hauglin et al.

[11] Patent Number: 5,803,480

[45] Date of Patent: Sep. 8, 1998

[54] SKI-BINDING ARRANGEMENT TO FIX A SKI BOOT TO A SKI, IN PARTICULAR A TOURING OR CROSS-COUNTRY SKI

[75] Inventors: Bernt-Otto Hauglin, Royken, Norway; Rod Johnson, Colfax, Calif.

[73] Assignee: Rottefella S.A., Norway

[21] Appl. No.: 553,451

[22] PCT Filed: May 1, 1994

[86] PCT No.: PCT/IB94/00105

§ 371 Date: Apr. 12, 1996

§ 102(e) Date: Apr. 12, 1996

[87] PCT Pub. No.: WO94/27692

PCT Pub. Date: Dec. 8, 1994

[30] Foreign Application Priority Data

May 27, 1993 [DE] Germany ..... 43 17 735.2
Nov. 11, 1993 [DE] Germany ..... 43 38 590.7

[51] Int. Cl.[6] ..... A63C 9/08

[52] U.S. Cl. ..... 280/615; 280/607; 280/618; 280/636

[58] Field of Search ..... 280/607, 614, 280/615, 617, 618, 636

[56] References Cited

U.S. PATENT DOCUMENTS

| | | | |
|---|---|---|---|
| 3,752,491 | 8/1973 | Fend | 280/618 |
| 3,764,155 | 10/1973 | Perryman | 280/618 |
| 3,781,028 | 12/1973 | Gertsch et al. | 280/618 |
| 3,951,424 | 4/1976 | Napfin | 280/614 |
| 4,172,602 | 10/1979 | Gertsch et al. | 280/618 |
| 4,928,988 | 5/1990 | Hue | 280/615 |
| 5,518,264 | 5/1996 | Broughton | 280/615 |

FOREIGN PATENT DOCUMENTS

| | | | |
|---|---|---|---|
| 1271671 | 8/1961 | France . | |
| 2506170 | 11/1982 | France | 280/614 |
| 2210338 | 3/1972 | Germany . | |
| 2806937 | 8/1978 | Germany . | |
| 2907365 | 2/1979 | Germany . | |
| 1703054 | 4/1979 | Germany | 280/614 |
| 29 07 365 | 8/1980 | Germany . | |
| 3310739 | 4/1982 | Germany . | |
| 634755 | 2/1983 | Germany . | |
| 3310739 | 10/1983 | Germany . | |
| 3421499 | 3/1984 | Germany . | |
| 3421499 | 12/1984 | Germany . | |
| 3443243 | 6/1985 | Germany . | |
| 3443243 | 6/1995 | Germany . | |
| 2210338 | 3/1971 | Switzerland . | |
| 634755 | 2/1983 | Switzerland . | |

*Primary Examiner*—Brian L. Johnson
*Assistant Examiner*—Min Yu
*Attorney, Agent, or Firm*—Andrus, Sceales, Starke & Sawall

[57] ABSTRACT

Ski-binding arrangement to fix a ski boot to a ski, in particular a touring or cross-country ski, with a latch mechanism to fix the front end of the ski boot to the ski in such a way that the metatarsus and heel can be raised freely from the upper surface of the ski. The latch mechanism can be attached to a holding plate (10). The holding plate (10) in turn is so disposed that it can swing out to the sides about an axis perpendicular to the surface of the ski against the action of spring-braced elements (12) of a locking mechanism (11), the lateral swinging movement being so extensive that the plate is completely freed from the ski. The holding plate (10) is supported by way of its extreme front end (13) on a retaining part (14) mounted on the upper surface (19) of the ski, the plate (10) being so disposed that it can swing sideways about said front end. The locking mechanism (11) is associated with the back end of the holding plate (10).

16 Claims, 2 Drawing Sheets

SKI-BINDING ARRANGEMENT TO FIX A SKI BOOT TO A SKI, IN PARTICULAR A TOURING OR CROSS-COUNTRY SKI

BACKGROUND OF THE PRESENT INVENTION

The invention relates to a ski-binding arrangement to fix a ski boot to a ski, in particular a touring or cross-country ski, with a latch mechanism to fix the front end of the ski boot to the ski in such a way that the metatarsus and heel can be raised freely from the upper surface of the ski, wherein the latch mechanism can be attached to a holding plate and the latter is disposed so as to be laterally rotatable about an axis perpendicular to the upper surface of the ski against the action of spring-braced elements of a locking mechanism, to such an extent that it is completely freed from the ski.

A safety binding of this kind has been disclosed, for example in DE 29 07 365 C2 or DE 33 10 739 C2. The known bindings of the stated kind are distinguished either by a holding plate anchored firmly to the ski or by holding plates which, although they do come entirely free from the ski when released, then swing out to the side about an axis of rotation situated in the back region of the holding plate or even at its back end. With this latter embodiment, to ensure release of the binding the boot and holding plate must be in torque-transmitting engagement by way of holding elements in the metatarsal region, so that the necessary releasing torque can be transmitted to the holding plate. As a result, it cannot be guaranteed that the binding will release when the metatarsus and heel are raised; the torque, which in this case is exerted only on the latched tip of the boot, is not sufficient to unlatch the holding plate. The consequence can be fracture of the toes or metatarsal bones.

The same consequences can occur in the case of safety ski bindings with holding plates firmly anchored to the ski.

SUMMARY OF THE PRESENT INVENTION

It is therefore the object of the present invention to produce a ski-binding arrangement of the kind cited at the outset that releases reliably even when the metatarsus or heel is raised, the construction simultaneously being made extremely compact.

In accordance with an aspect of the invention, a holding plate in accordance with the invention is supported at its extreme front end on the ski or on a retaining part mounted on the upper ski surface in such a way that it can rotate to the side about its front end, whereas the locking mechanism is associated with the back end of the holding plate. As a result of this principle of construction, release of the holding plate or binding is guaranteed even if, for example, the heel is raised so that torque is exerted only on the tip of the boot, whch is latched to the holding plate. Functional reliability of the ski-binding arrangement in accordance with the invention is therefore considerably increased in comparison to known arrangements, with no need for additional structural elements that could make the binding arrangement less compact.

Preferably between the front and back ends of the holding plate the plate is held additionally by a slideway open toward the sides and fastened to the upper surface of the ski, so that the slideway determines the radius of rotation of the holding plate about its extreme front end. By this means the outward-swinging movement of the holding plate is defined. Furthermore, this measure allows the holding plate, after it has been freed from the ski, to be readily returned or swung back to its initial position. Finally, it also ensures that when the holding plate swings slightly outward it will be freed from the ski immediately. It very often happens that in a fairly gentle fall the holding plate swings only slightly outward, so that it is not released from the ski at all and hence can simply be swung back into the locked position.

A particularly simple and functionally reliable construction is distinguished by the nature of the swivel bearing at the extreme front end of the holding plate, which consists of a curved tongue on the one hand and a complementary tongue-receiving slot open toward the back on the other hand. The tongue-receiving slot has a double function. It serves both as a secure retainer of the front end of the holding plate and as its swivel bearing.

In an alternative construction, the swivel bearing of the holding plate at its extreme front end can consist of a tongue that projects forward, on the one hand, and a tongue-receiving slot open toward the back in such a way that the tongue can move, in particular can slide, in the long direction of the ski within the tongue-receiving slot. Along with the advantages mentioned above, this has the additional advantage of compensating for bending. That is, because the ski, in particular a touring or cross-country ski, in the unloaded state is arched so that the front and back ends are lower than the middle, whereas in the loaded state it is flattened so that it lies almost in a plane, it is especially useful for the construction of the ski-binding arrangement attached to the upper surface of the ski to allow length changes related to the change of length of the ski in its long direction associated with bending of the ski. One result is that the ski remains decidedly elastic, in particular in the region of the ski-binding arrangement, with the consequence of improved user comfort. Another is that because external forces and the associated tensions transmitted to the ski by way of the binding are reduced, the ski therefore has a considerably longer service life.

To achieve this, the tongue has two lateral curved surfaces, on opposite sides from one another, and within the tongue-receiving slot there are two bearing surfaces also disposed opposite one another at the sides, which interact with the two curved surfaces of the tongue. In practice it has proved extremely useful in this regard for the tongue of the holding plate with its curved surfaces to be slidable in the long direction of the ski, within the receiving slot with its bearing surfaces, over a distance of about 0.5 mm to 5 mm, in particular about 1 mm to 3 mm, preferably about 2 mm.

The parts of the above-mentioned slideway on the ski side, and the parts of the locking mechanism on the ski side, can be mounted either directly on the upper surface of the ski or, preferably, on a base plate that can be attached to the ski surface.

In a preferred concrete embodiment, the slideway of the holding plate is formed on the one hand by a curved guide plate disposed, in particular screwed, below the slideway and spaced apart therefrom, and on the other hand by a complementary curved guide element mounted on the base plate, the curved guide element being likewise platelike is structured so as to ensure a low height of the binding arrangement overall. At the back end of the curved guide plate, which is situated below the holding plate and accordingly covered by the latter, a notch or similar indentation is provided which interacts with a corresponding locking element of the locking mechanism.

The binding arrangement in accordance with the invention is particularly suitable for assembly of so-called TELEMARK bindings, in which case the corresponding boot-attachment elements are mounted on the holding plate.

BRIEF DESCRIPTION OF THE DRAWINGS

Regarding further constructional details of the binding arrangement in accordance with the invention, reference is made to the subordinate claims and to the following description of an exemplary embodiment with accompanying drawings, wherein

DESCRIPTION OF THE ILLUSTRATED EMBODIMENT

Figure 2:
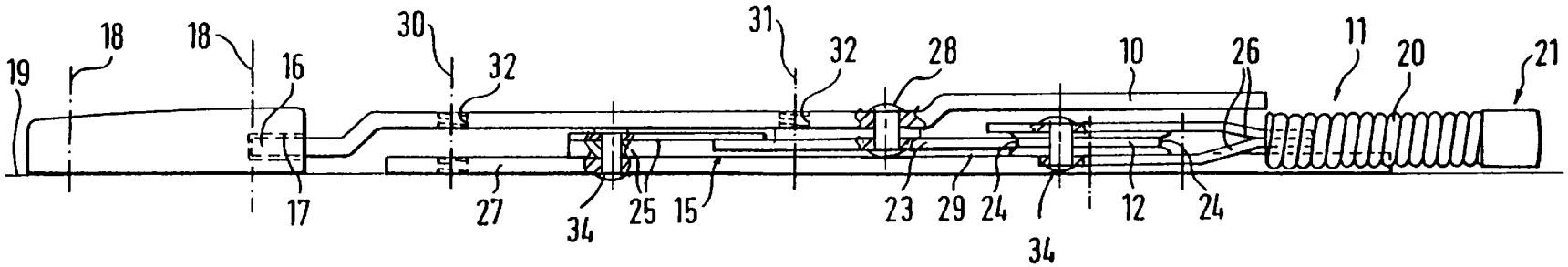
FIG. 2 shows the ski-binding arrangement of FIG. 1 in side view.
Figure 1:
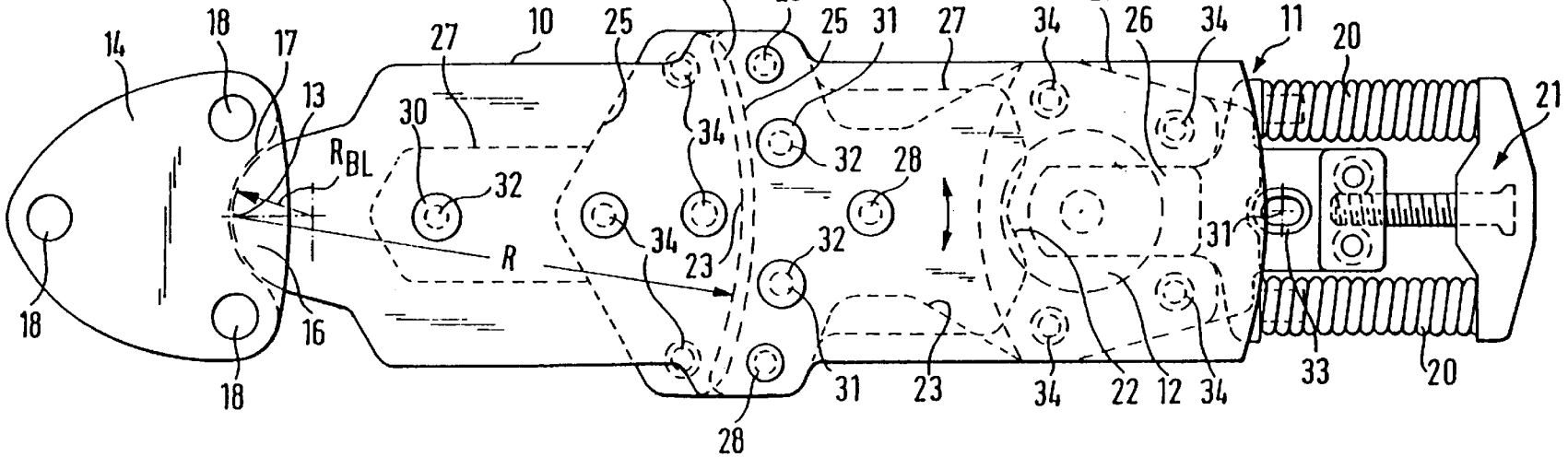
FIG. 1 shows a first embodiment of a ski-binding arrangement in accordance with the invention, in plan view.

The first embodiment of a ski-binding arrangement shown schematically in FIGS. 1 and 2 serves to fix a ski boot to a ski, in particular a touring or cross-country ski. It comprises a latch mechanism, not shown here, to fix the front end of the ski boot to the ski in such a way that the metatarsus and heel can be lifted away from the upper surface of the ski. The latch mechanism, in particular telemark latch mechanism, can be attached to a holding plate 10. This holding plate is so disposed as to be rotatable about an axis perpendicular to the upper surface of the ski, so that it can swing out to the side against the action of spring-braced elements, here the locking disk 12, of a locking mechanism 11, far enough that it goes beyond a predetermined swing angle at which it is completely freed from the ski.

The holding plate 10 in the first embodiment shown here is supported by its extreme front end 13, in such a way that the plate 10 can be swung out to the side, on a retaining part 14 that is mounted on the upper surface of the ski. The locking mechanism 11 is disposed at the back end of the holding plate 10. That is, the vertical axis of rotation of the holding plate 10 is situated at the extreme front end 13 of the holding plate 10. Between the front and back ends of the holding plate 10, the latter is additionally retained by a slideway 15 that opens toward the sides of the ski, which determines the radius R of rotation of the holding plate about its extreme front end 13.

As can be seen especially clearly in FIG. 1, the axis of rotation of the holding plate 10 at its extreme front end 13 is formed by a curved tongue 16 and a complementary tongue-receiving slot 17 that opens toward the back. That is, the interior wall of the receiving slot 17 has a shape complementary to that of the leading edge of the curved tongue 16. The tongue-receiving slot 17 in the embodiment shown here is formed in the back face of the retaining part 14, which can be attached to the upper surface 19 of the ski (not shown) with three screws 18.

The radius $R_{BL}$ of the curved tongue 16 is about ⅕ to 1/10, in the present case about ⅙ of the radius of rotation R of the holding plate 10 defined by the slideway 15.

The locking mechanism 11 comprises a locking element movably disposed on the ski under tension exerted by two springs 20, which has the form of a locking disk 12 rotatably mounted on an axis perpendicular to the ski surface 19. The action of the springs 20 pushes the locking disk 12 forward in the long direction of the ski, i.e. toward the holding plate 10. As is shown clearly in FIG. 2, the holding plate 10 extends backward over part of the locking mechanism 11, covering the latter. Only the springs 20 and a device 21 to adjust the spring tension project backward beyond the back end of the holding plate 10.

The locking disk 12 is associated with a locking notch 22 of the holding plate 10, which in this case is part of a slideway element 23 disposed below the holding plate 10. As shown in FIG. 2, the locking disk 12 comprises a circumferential groove 24 to receive the complementary locking notch 22. This arrangement additionally secures the holding plate 10 against upward displacement when the plate 10 is in its operating position.

The parts 25 on the ski side of the above-mentioned slideway 15, as well as the parts on the ski side of the locking mechanism 11—namely the locking disk 12, bearing fork 26 for the locking disk, springs 20 and adjustment device 21—are attached to a base plate 27 that is mounted on the upper ski surface 19. An extremely compact and stable component is thereby achieved, which comprises the base plate 27, holding plate 10, slideway 15 and locking mechanism 11.

The slideway 15 of the holding plate 10 in the embodiment shown here is formed by a curved guide plate 23 disposed, namely screwed (connecting screw 28), below the holding plate 10 and spaced apart therefrom, with which is associated a guide element 25 with a complementary curvature, which is mounted on the base plate 27 such that its edge overlaps that of the guide plate 23. The curved guide element 25 consists of a material with slight frictional resistance, in particular a plastics such as a tetrafluoro hydrocarbon (Teflon). As explained above, the locking notch 22 associated with the locking disk 12 of the locking mechanism 11 is formed in the back edge of the curved guide plate 23. On the ski side, i.e. toward the base plate, the curved guide plate 23 is slidably supported by a layer 29 with slight frictional resistance, e.g. a tetrafluoro hydrocarbon (Teflon). The layer 29 in the embodiment shown here is an integral component of the curved guide element 25 mounted on the base plate 27.

The base plate 27 can be fastened to the upper surface 19 of the ski by several screws 30, 31, so disposed that when the holding plate 10 is locked into its operating position, the screws 30, 31 are aligned with threaded bores 32 disposed in the holding plate 10 for the purpose of fixing the boot-attachment mechanism, in particular a telemark binding. Hence the base plate 27 and thus the entire binding arrangement can be fastened to the upper surface 19 of the ski through the threaded bores 32 in the holding plate 10. Screw holes are drilled into the upper surface 19 of the ski through these threaded bores 32. It is also through the bores 32 that the base-plate-fastening screws are screwed into the screw holes drilled into the ski surface. The arrangement of the threaded bores 32 in the base plate 27, which are associated with the fastening screws 30, 31, and that of the threaded bores 32 in the holding plate 10 preferably corresponds to the standard arrangement for the attachment of a binding to a touring or cross-country ski, in particular the standard for the attachment of a telemark binding to a ski.

The base plate 27 itself is unmovably attached to the upper surface 19 of the ski by way of an anterior screw 30 and a threaded bore 32 in the holding plate 10. In contrast, the additional screws 31 pass through the base plate 27 by means of an elongated hole 33 extending in the long direction of the ski, to permit a change in length of the ski as it is flattened by an imposed load. The elongated holes 33 in the base plate 27 in this sense ensure an axial relative movement between the base plate 27 and the ski. Of the elongated holes 33, only the one at the back end of the base plate 27 is visible in FIG. 1.

The curved guide element 25 is attached to the base plate 27 by means of screws or rivets 34. The locking mechanism 11 is similarly attached to the base plate 27 by screws or rivets 34. The attachment of the curved guide plate 23 to the underside of the holding plate 10 is likewise achieved by screws or rivets 28.

The holding plate 10, curved guide plate 23, base plate 27, and locking mechanism 11 preferably consist of non-rusting metal. The front retaining part 14 can be made either of metal or of plastics suitable for skis.

Figure 3:
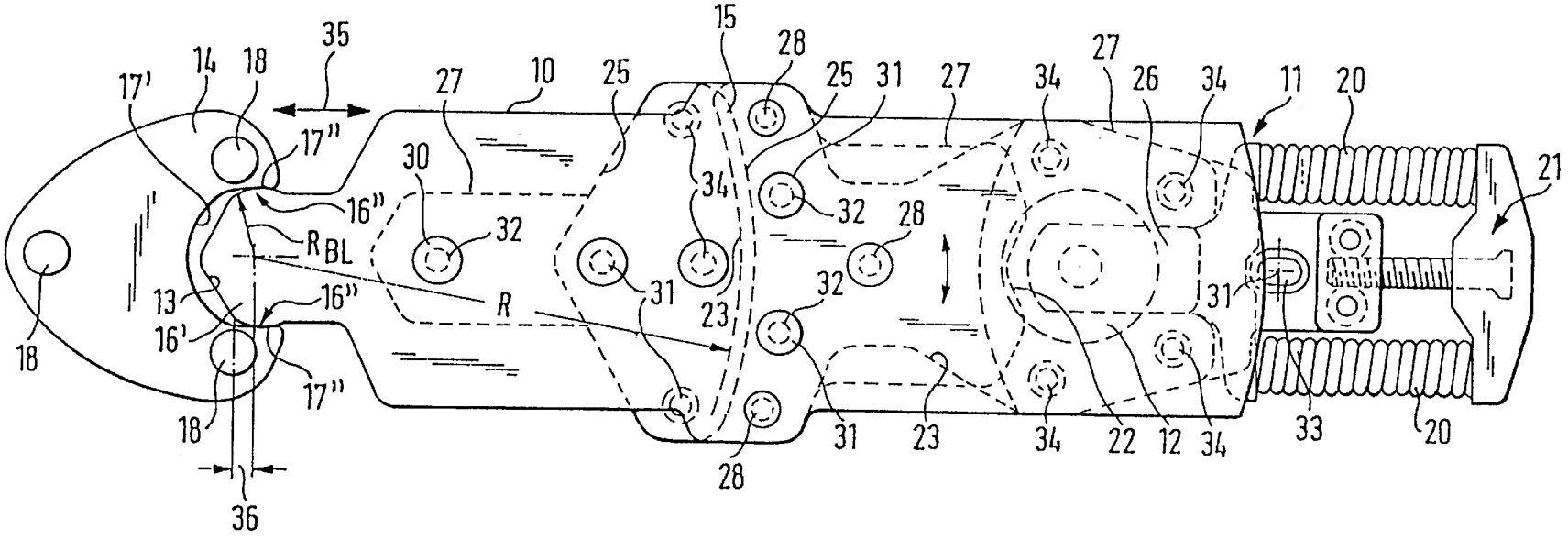
FIG. 3 shows a second embodiment of a ski-binding arrangement in accordance with the invention in plan view.

The additional embodiment of a ski-binding arrangement shown schematically in FIG. 3 likewise serves to fix a ski boot to the ski, in particular a touring or cross-country ski. The embodiment of the ski-binding arrangement according to FIG. 3 corresponds substantially to that shown in FIGS. 1 and 2, and where it does so similar components are identified by the same reference numerals.

The second embodiment of the ski-binding arrangement according to FIG. 3 differs from that according to FIGS. 1 and 2 merely with respect to the swivel bearing of the holding plate 10 in the region at the extreme front end 13 of the latter. Here the swivel bearing of the holding plate 10 at its extreme front end 13 is formed on the one hand by by a forward-projecting tongue 16' and on the other hand, by a tongue-receiving slot 17' that opens backward, the construction being such that the tongue 16' can be moved or slid within the tongue-receiving slot 17' in the long direction of the ski as shown by the double-headed arrow 35. As a result, even slight changes in length of the ski in the region of the ski-binding arrangement during the imposition of weight can be reliably compensated, in that an axial relative movement can occur between the tongue 16' and the receiving slot 17'.

As can clearly be seen in FIG. 3, the tongue 16' has two lateral curved surfaces 16", positioned immediately opposite one another. The tongue-receiving slot 17' is provided at corresponding positions with two lateral bearing surfaces 17", directly opposed to one another so that they interact with the two curved surfaces 16" of the tongue 16'. In this way the tongue 16' of the holding plate 10, with its curved surfaces 16", is movable or slidable within the receiving slot 17' with its bearing surfaces 17", in the long direction of the ski as shown by the double-headed arrow 35, preferably over a distance 36 of about 0.5 mm to 5 mm, in particular approximately 1 to 3 mm, advantageously about 2 mm.

All the characteristics disclosed in the application documents are claimed as essential to the invention, to the extent that they are new to the state of the art singly or in combination.

We claim:

1. A ski-binding apparatus to fix a ski boot to a ski including touring skies, comprising a ski holding plate including a first portion of a slideway having a front end and a back end, a front support having a member adapted to be releasably coupled to the front end of said holding plate (10) and permitting the holding plate to swing about an axis perpendicular to the surface (19) of the ski, a locking mechanism (12) releasably coupled to the back end of the holding plate and permitting said swinging movement of the plate (11) to completely free the plates from the ski, and including a slideway (15) formed by a first and a second portion, the first portion is secured to the holding plate (10) between the front and back ends of the holding plate (10) and the second portion is adapted to be secured to the ski, said slideway (15) opening towards the sides of the plate and the ski and said slideway (15) establishing a radius of rotation (R) of the holding plate (10) about said front end (13).

2. The apparatus of claim 1 including a swivel bearing unit coupled to the holding plate (10) at said front end (13), said bearing unit including a forward-projecting curved tongue (16') on said front end and said bearing unit member adapted to be secured to the ski and including a complementary tongue-receiving slot (17') opened toward the back end of the plate to receive said tongue, and wherein said tongue comprises two lateral curved surfaces (16") extending laterally in directly opposite directions from one another, and the tongue-receiving slot (17') comprises two lateral bearing surfaces (17") extending directly opposite one another and supporting the two curved surfaces (16") of the tongue (16').

3. The apparatus of claim 2, wherein said slot is elongated and the tongue (16') is movable longitudinal within the elongated slot (17') over a distance (36) of substantially 0.5 mm to 5 mm.

4. The apparatus of claim 3 wherein said slot is elongated and the tongue (16') is movable longitudinal within the elongated slot (17') over a distance (36) of substantially 1 mm to 3 mm.

5. The apparatus of claim 3 wherein said slot is elongated and the tongue (16') is movable longitudinal within the elongated slot (17') over a distance (36) of substantially 2 mm.

6. The apparatus of claim 1 wherein said locking mechanism (11) comprises a first locking element adapted to be secured to the ski and a second locking element on the back end of the holding plate on the ski, and at least one of said locking elements being rotatably mounted about an axis perpendicular to the upper surface (19) of the ski and an elastic element coupled to urge said locking elements into releasable engagement, and said holding plate (10) extends backward in covering relationship to at least part of the locking mechanism (11).

7. The apparatus of claim 6 wherein said first element is a rotating locking disk (12) adapted to be secured to the ski and the other locking element is a part of the holding plate (10) and includes an indentation releasably engaging said disk (12).

8. The apparatus of claim 7 wherein said locking disk (12) includes a circumferential groove (24) to receive the complementary locking indentation (22) of the holding plate (10).

9. The apparatus of claim 1 including a base plate (27) adapted to be secured to the upper surface (19) of the ski, said second portion of the slideway and said locking mechanism being secured to said base plate.

10. The apparatus of claim 9 wherein said first portion of the slideway (15) includes a curved plate (23) connected to the holding plate (10) and located in spaced relation beneath the holding plate, and said second portion of the slideway including a complementary curved guide element (25) adapted to be mounted on the ski and having an edge overlapping and engaging said curved guide plate (23).

11. The apparatus of claim 10 wherein said curved guide plate (23) includes a back end having an indentation, said locking element engaging said indentation in the back end of said curved guide plate (23).

12. The apparatus of claims 10 wherein said curved guide plate (23) is slidably supported on the base plate (27) by way of a plastic layer (29) with low frictional resistance.

13. The apparatus of claim 12 wherein said layer of plastic is tetrafluoro hydrocarbon.

14. The apparatus of claim 12 wherein said curved guide element (25) is made of a material having low frictional resistance and the curved guide element (25) is coupled to the supporting layer (29) for the curved guide plate (23).

15. The apparatus of claim 9 wherein said base plate (27) includes openings, fastening elements to secure the base plate to the ski through said openings, said holding plate (10) has spaced openings aligned with said fastening elements and in the locked position of the plate, said openings in said holding plate (10) being adapted to secure an attachment apparatus to the holding plate.

16. The apparatus of claim 15 wherein said openings in said holding plate (10) are threaded bores (32) in the holding plate (10) and corresponds to a known standard arrangement of holes for the fixation of known TELEMARK attachment apparatus.

* * * * *

UNITED STATES PATENT AND TRADEMARK OFFICE

CERTIFICATE OF CORRECTION

PATENT NO. : 5,803,480

DATED : September 8, 1998

INVENTOR(S) : BERNT-OTTO HAUGLIN ET AL

It is certified that error appears in the above-indentified patent and that said Letters Patent is hereby corrected as shown below:

Title page,

[73] Assignee: delete "S.A." and substitute therefor -- AS --.

Claim 1, column 5, line 57, delete "(11)" and substitute therefor -- (10) --; Claim 2, column 6, line 2, after "end" insert -- , --.

Signed and Sealed this

Sixteenth Day of November, 1999

*Attest:*

Q. TODD DICKINSON

*Attesting Officer*

*Acting Commissioner of Patents and Trademarks*